US006085927A

United States Patent [19]

Kusz

[11] Patent Number: 6,085,927

[45] Date of Patent: Jul. 11, 2000

[54] CONTAINER WITH INSERT TO REDUCE EFFECTIVE VOLUME AND PACKAGE INCORPORATING SAME

[75] Inventor: Maximillian Kusz, Perrysburg, Ohio

[73] Assignee: Owens-Illinois Closure Inc., Toledo, Ohio

[21] Appl. No.: 09/351,810

[22] Filed: Jul. 12, 1999

[51] Int. Cl.[7] ..... B65D 21/02

[52] U.S. Cl. ..... 220/23.87; 220/23.89; 220/592.28; 215/6

[58] Field of Search ..... 220/23.87, 23.89, 220/592.23, 592.27, 592.28; 215/1 C, 6, 10; 206/499, 514

[56] References Cited

U.S. PATENT DOCUMENTS

| | | | |
|---|---|---|---|
| 2,072,630 | 3/1937 | Ferry | 215/6 X |
| 3,156,279 | 11/1964 | Grebowiec et al. | 220/23.87 X |
| 3,275,180 | 9/1966 | Optner et al. | 220/23.89 X |
| 3,599,838 | 8/1971 | LaVange | 215/6 X |
| 3,766,975 | 10/1973 | Todd | 220/592.28 X |
| 4,915,255 | 4/1990 | Curtis | 220/23.89 |
| 5,197,602 | 3/1993 | Biesecker et al. . | |
| 5,318,183 | 6/1994 | Cohen et al. . | |

*Primary Examiner*—Steven Pollard

[57] ABSTRACT

A package (10) made up of a blow molded thermoplastic outer container (12) and an injection molded thermoplastic inner container (14) inserted into the outer container through an annular closing receiving finish (18) of the outer container (12). The inner container has a lower major portion (20) of frustoconical configuration and an upper minor portion (22) of cylindrical configuration that is closely surrounded by the closure receiving finish portion of the outer container. The upper minor portion of the inner container (14) has an outwardly projecting bead (24) that is received in an inwardly facing recess (30) of the closure receiving finish portion of the outer container to position a rim (26) of the inner container at an elevation that is slightly above a rim (28) of the closure receiving finish portion of the outer container. A closure (16) with a liner (32) therein is removably secured to the closure receiving finish portion of the outer container with the liner preferably in sealing engagement with the rim of the inner container and also in sealing engagement with the rim of the outer container.

10 Claims, 4 Drawing Sheets

CONTAINER WITH INSERT TO REDUCE EFFECTIVE VOLUME AND PACKAGE INCORPORATING SAME

BACKGROUND OF THE INVENTION

1. Field of the Invention

This invention relates to a package with an outer container of a given volume and an inner container of a lesser volume inserted within the outer container to permit outer containers of a given size to be used for packaging varying volumes of contents without excessive unused volume within the package item that actually holds the packaged product. A closure is removably affixed to an annular finish portion of the outer container to complete a package that is made up of the inner and outer containers.

2. Description of the Prior Art

The use of an inner container in the form of a vial inserted within an outer container in the form of a bottle to reduce the excessive volume of the outer container has heretofore been disclosed, for example, in U.S. Pat. No. 5,318,183 (Cohen et al.) and U.S. Pat. No. 5,197,602 (Biesecker et al.).

The use of an inner container within an outer container according to the teachings of the aforesaid references pennits packaging of varying volumes of products, such as various medications, without changing the outer container used therefor or the handling equipment used in processing the outer container or filling the inner container, and without compromising available space for labeling the outer container. A problem has arisen, however, in venting the outer container to permit egress of air therein in sufficient volume to permit insertion of the inner container, as the inner container must fit securely within the neck of the outer container to frictionally restrict relative movement between the inner container and the outer container as they proceed through the distribution system.

Another problem encountered with prior art reduced volume containers arises with respect to sealing the rim of the inner container, because such prior art containers have the elevation of the rim of the inner container at, or below, the elevation of the rim of the outer container. This tends to cause the liner of an associated closure to seal against the rim of the outer container rather than the rim of the inner container, which is the important sealing surface in the package because it is the surface of the container that directly contains the packaged product.

SUMMARY OF THE INVENTION

The aforesaid and other problems associated with prior art reduced effective volume containers are solved by the package of the present invention in which an inner container, preferably a molded plastic inner container in the configuration of a vial, is inserted into an outer container, preferably a molded plastic outer container in the configuration of a bottle, through an annular neck of the outer container with a frictional fit between an outer surface at an open mouth of the inner container and an inner surface of the neck of the outer container that positively positions the rim at the mouth of the inner container at a slightly higher elevation than the rim of the neck of the outer container, in the normal, upright orientation of the inner and outer containers. By this arrangement, a foil or film lined liner member of a closure that is applied to seal the package that contains the inner and outer containers will selectively seal against the rim of the inner container, and that is the surface of the package of primary importance in properly sealing the contents of the package.

The package of the present invention also has improved venting during insertion of the inner container into the outer container by providing the inner container with a generally frustoconical major lower portion, whose maximum outside diameter is smaller than the inside diameter of the neck of the outer container. Thus, during the insertion of the inner container into the outer container, there is no effective restriction on the venting of the outer container while the inner container is being inserted therein, at least until a minor, cylindrical portion at the open end of the inner container passes into the outline of the neck of the outer container, which doesn't occur until late in the insertion step. The venting of the outer container also occurs after completion of the insertion of the inner container into the outer container, notwithstanding the required frictional fit between the exterior of the cylindrical portion of the inner container and the interior of the neck portion of the outer container. The insertion of the inner container into the outer container proceeds until an outwardly projecting bead on the cylindrical portion of the inner container rests on the rim of the outer container. No resistance to venting has developed through this step. Then, a force is applied to the inner container to force it into the outer container until the bead on the inner container is received in an inwardly facing recess in the neck of the outer container, whereupon the inner container and the outer container will be positively positioned relative to one another, with the rim of the inner container above the rim of the outer container. Any compression of air in the outer container during the forceable insertion of the inner container into the outer container will usually be insufficient to materially outwardly bow the sides of the outer container, that is, it will be insufficient to cause problems in the affixing of labels to an outer container of square configuration; in any case, such problem if encountered, can be overcome by segmenting or interrupting the bead to provide escape path(s) for air trapped in the outer container.

Accordingly, it is an object of the present invention to provide an improved package that includes an inner container within an outer container to reduce the effective volume of the outer container. More particularly, it is an object of the present invention to provide a package as described above in which the rim of the inner container is positioned at least slightly above the rim of the outer container, to facilitate application of a foil or film lined sealing liner element of a closure member to the rim of the inner container. Even more particularly, it is an object of the present invention to provide a package as described above in which the outer container is effectively vented to discharge air resulting from inserting of the inner container into the outer container.

For a further understanding of the present invention and the object thereof, attention is directed to the drawing and the following brief description thereof, to the detailed description of the preferred embodiment and to the appended claims.

DETAILED DESCRIPTION OF THE PREFERRED EMBODIMENT

Figure 1:
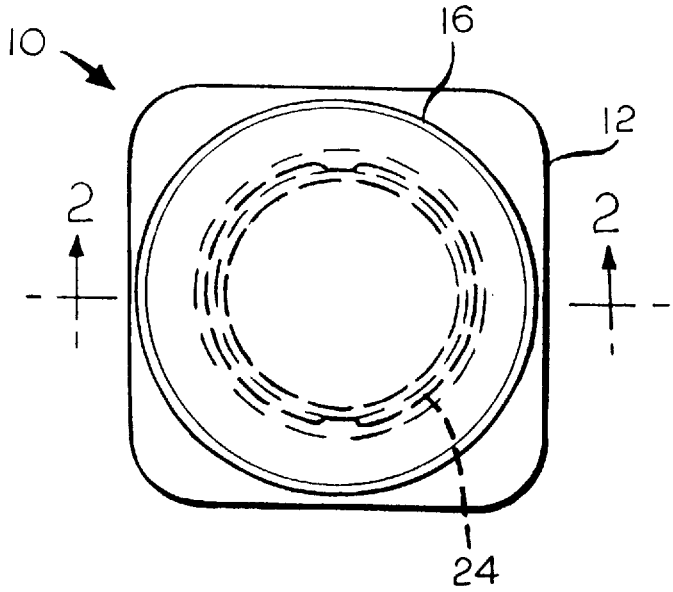
FIG. 1 is a top plan view of a package according to the preferred embodiment of the present invention.
Figure 2:
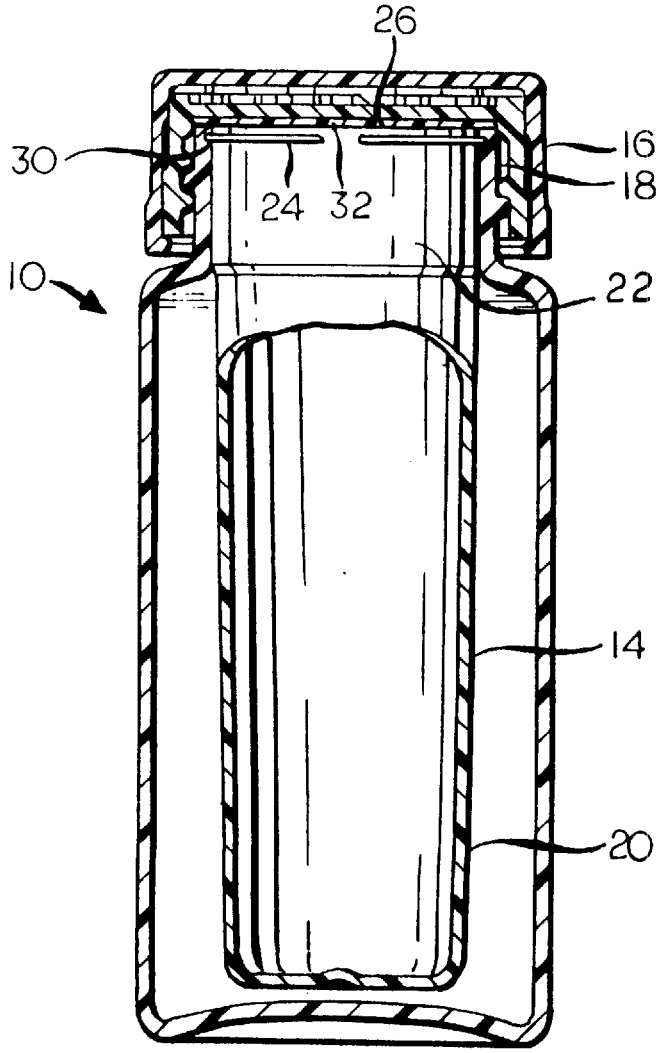
FIG. 2 is a view, partly in section, taken on line 2—2 of FIG. 1.

A package according to the preferred embodiment of the present invention is identified generally by reference numeral 10 in FIGS. 1 and 2, and the package 10 is made up of an outer container 12, an inner container 14 and a closure 16 removably applied to an annular finish portion 18 that surrounds an open neck of the outer container 12. Products (not shown) to be packaged in the package 10 are inserted into the inner container 14, before the closure 16 is applied to the finish portion 18 of the outer container 12, and the volume occupied by such products may be considerably less than the internal volume of the outer container 12 without leaving excessive unoccupied internal volume that could lead to product degradation during the handling of a number of packages 10 and without requiring the use of a smaller outer container, with a resultant decrease in available labeling space, to prevent such degradation. As shown, the outer container 12 is in the configuration of an otherwise conventional bottle, and may be made in its illustrated configuration from a suitable rigid thermoplastic material, such as high density polyethylene or polypropylene, by blow molding. The inner container 14 may also be made in its illustrated configuration, which is generally that of a vial, from such a rigid thermoplastic material, and is preferably made by injection molding. A package 10, as described, is especially well suited to the packaging of prescription pharmaceutical products, because it permits the use of a standard outer container 12, which has ample space for a label and use instructions, to package variable small volumes of the packaged medication.

Figure 3:
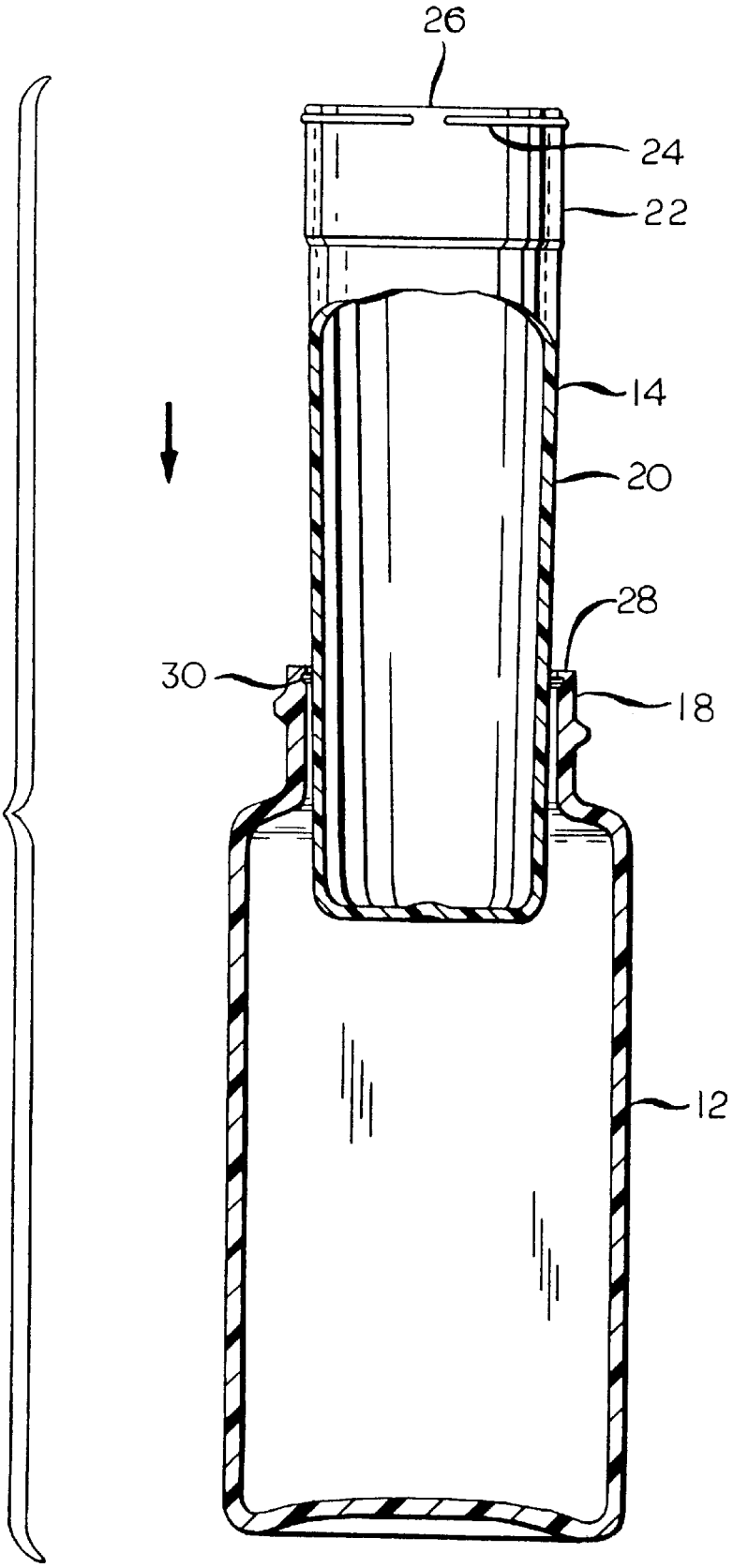
FIG. 3 is an exploded view showing a step in the assembly of certain of the components of the package of FIGS. 1 and 2.

The inner container 14 is provided with a lowermost major portion 20, which is of frustoconical configuration and has a smooth outer surface. The inner container 14 also has an uppermost minor portion 22, which is of cylindrical configuration, and the outside diameter of the minor portion 22 is sized to fit snugly within the inside diameter of the finish portion 18 of the outer container 12 and is greater than the outside diameter of the minor portion 20 at every location along the longitudinal extent of the minor portion 20. Thus, when the inner container 14 is inserted into the outer container 12, as is shown in FIG. 3, there will be a clearance between the inside of the annular finish 18 and the outside of the minor portion 20 to permit the venting of air within the outer container 12 to make up for the internal volume of the outer container 12 that is being filled by the inner container 14.

Figure 4:
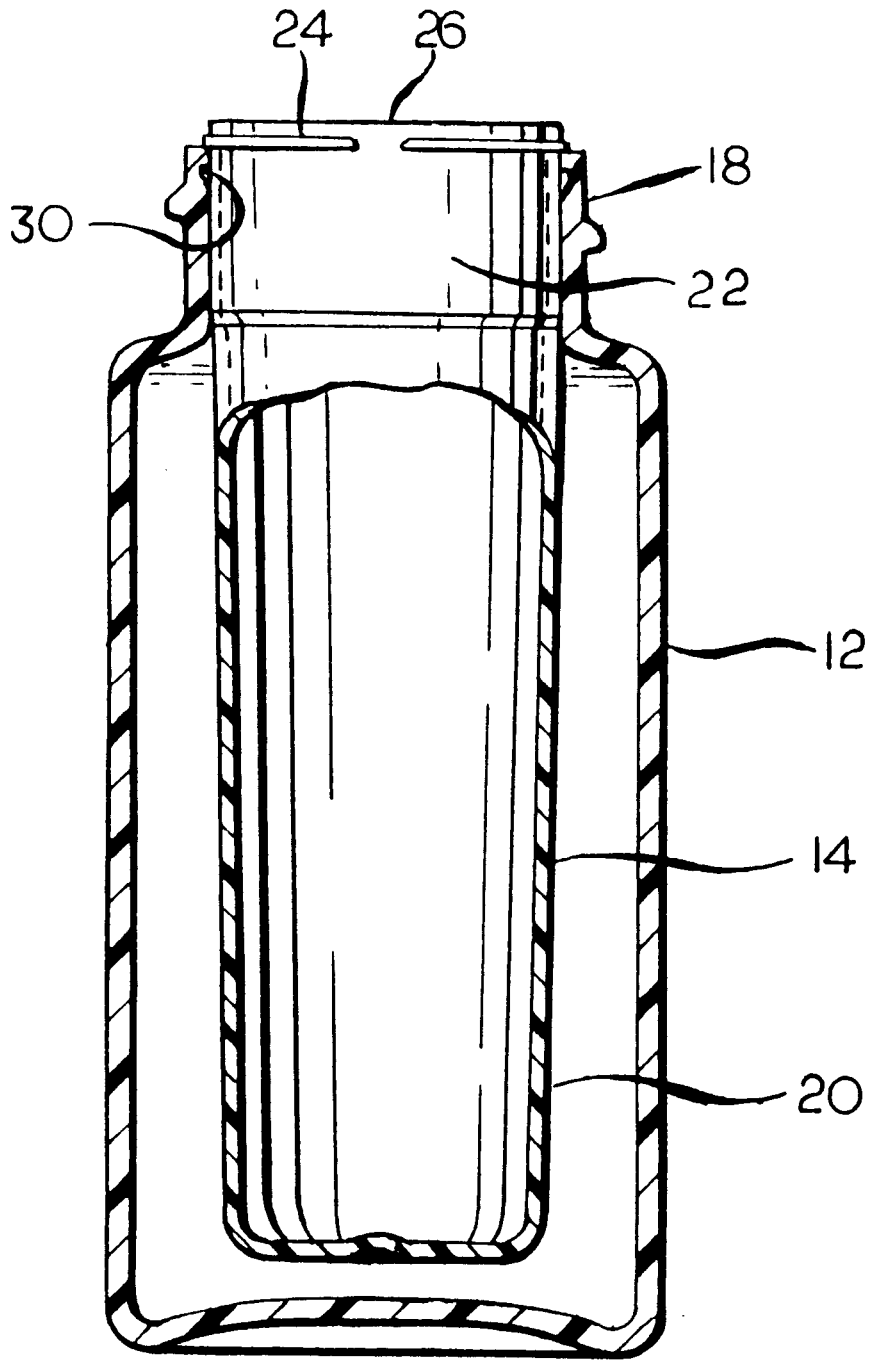
FIG. 4 is an elevational view, partly in cross section, showing a subsequent step in the assembly of certain of the components of the package of FIGS. 1 and 2.

The cylindrical, minor portion 22 of the inner container 14 is provided with a radially outwardly projecting bead 24 at an elevation that is spaced a short distance below a rim 26 of the cylindrical portion 20, and insertion of the inner container 14 into the outer container 12 proceeds until the segmented bead 24 comes to rest on a rim 28 at the top of the annular finish 18 of the outer container 12, as shown in FIG. 4. To complete the assembly of the inner container 14 into the outer container 12, a top load is then applied to the inner container 14 to force the bead 24 into the annular finish 18 of the outer container 12, in an interference fit, until the bead 24 is received in a radially inwardly facing annular recess 30 in the annular finish 18 of the outer container 12, at a location spaced a short distance below the rim 28 of the outer container 12 and sufficiently close to the rim 28 to ensure that the rim 26 of the inner container 14 will be at least slightly above the rim 28 of the outer container 12 when the bead 24 is received in the recess 30, as is shown quite clearly in FIG. 2A. The bead 24 of the inner container may be continuous, if no further venting of the outer container is required, or it may be interrupted or segmented if further venting is required. When the bead 24 of the inner container 14 is interrupted, and the fact that the bead 24 causes the annular finish 18 to expand during the final insertion of the inner container 14 into the outer container 12, any air remaining in the outer container 12 will be able to vent between the segments of the bead 24 during or shortly after the final insertion step.

Figure 2A:
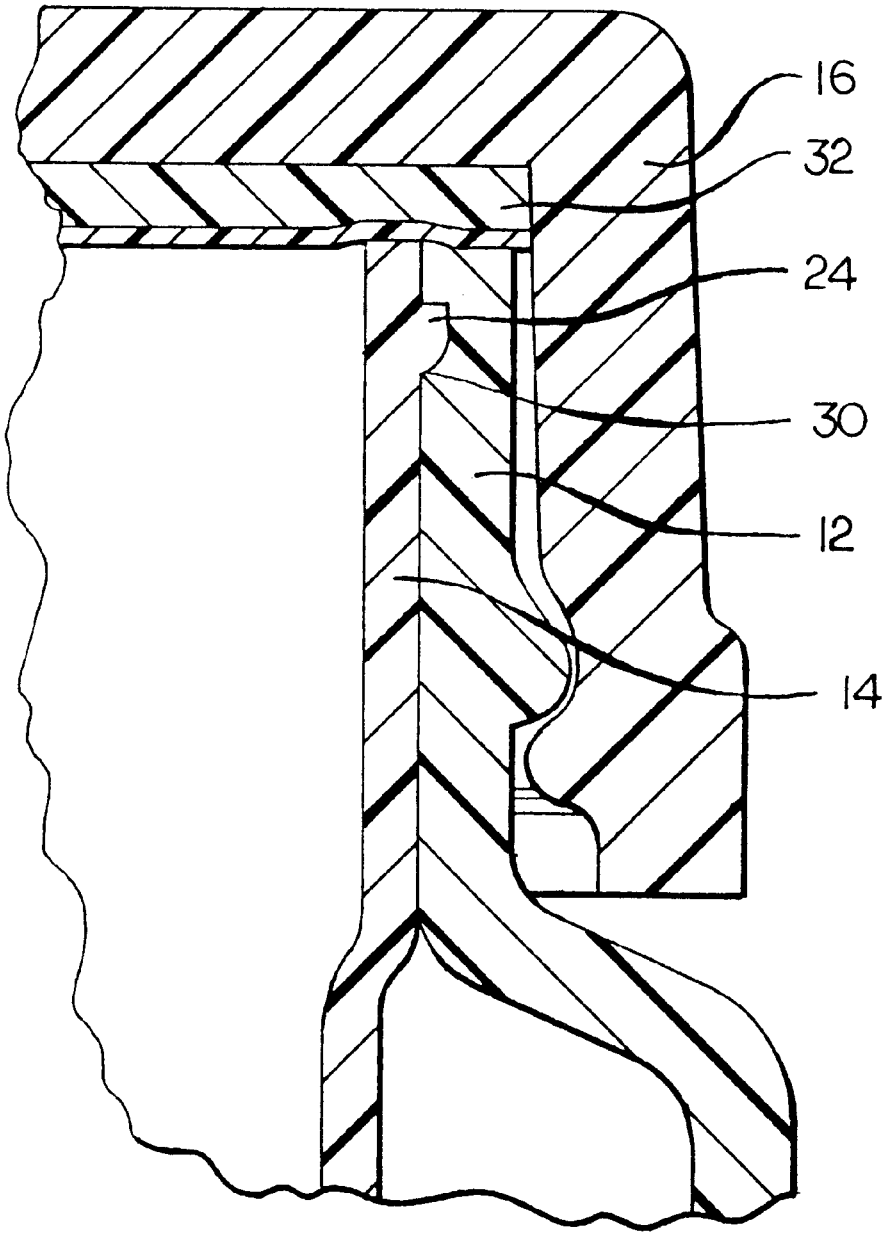
FIG. 2A is a fragmentary view, at an enlarged scale, of a portion of the package shown in FIG. 2.

The positioning of the bead 24 of the inner container 14 relative to the rim 26 of the inner container 14, and the positioning of the recess 30 of the outer container 12 relative to the rim 28 of the outer container 12, ensures that the rim 26 of the inner container 14 will be positioned slightly above the rim 28 of the outer container 12 when the inner container 14 and the outer container 12 are in their final assembled relationship. This will ensure that foil or an aluminum thermoplastic film lined sealing liner element 32 of the closure 16, which is shown as being of the type that has child-resistant opening characteristics, will preferably seal against the rim 26 of the inner container 14 when the closure 26 is tightened with sufficient torque to compress the sealing liner 32, as shown in FIG. 2A. If the sealing liner 32 is aluminum foil lined on its interior surface, an effective foil seal can be obtained between the closure 16 and both the inner container 14 and the outer container 12 through induction heating, which leads to releasable fusion of the aluminum to the rim 26 of the inner container 14 and to the rim 28 of the outer container 12.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A combined container comprising:

an outer container having an annular, closure receiving finish portion with a rim; and an inner container positioned in large part within said outer container, said inner container having a lower major portion and an upper minor portion, said upper minor portion being of cylindrical configuration with a rim and being surrounded in large part by said annular closure receiving finish portion of said outer container with said rim of said inner container positioned at least slightly above said rim of said outer container, every portion of said lower major portion of said inner container having a lesser radial extent than a radial extent of said upper, minor portion of said inner container;

wherein said lower, major portion of said inner container is frustoconical in configuration; and wherein said upper minor portion of said inner container has a radially outwardly projecting bead at an elevation below said rim of said inner container, and wherein said annular closure receiving finish portion of said outer container has an annular, radially inwardly facing recess at an elevation below said rim of said outer container, said bead of inner container being received in said recess of said outer container.

2. A combined container according to claim 1 wherein said bead has at least one interruption extending therethrough.

3. A combined container according to claim 1 and further comprising:

a closure having a liner, said closure being removably secured to said annular closure receiving finish portion of said outer container with said liner in engagement with said rim of said inner container.

4. A combined container according to claim 3 wherein said liner of closure sealingly engages said rim of said inner container and said rim of said outer container.

5. A combined container according to claim 4 wherein said liner of said closure is provided with a layer of aluminum foil in engagement with said rim of said inner container and said rim of said outer container.

6. A combined container according to claim 5 wherein said layer of aluminum foil is releasably fused to said rim of said inner container and said rim of said outer container.

7. A combined container according to claim 5 wherein there is an interference fit between an outside of said upper minor portion of said inner container and an inside of said closure receiving finish portion of said outer container.

8. A combined container according to claim 1 wherein said lower major portion of said inner container has a smooth outer surface.

9. A combined container according to claim 1 wherein said outer container is formed from a thermoplastic material by blow molding.

10. A combined container according to claim 1 wherein said inner container is formed from a thermoplastic material by injection molding.

* * * * *